United States Patent [19]

Waldrep

[11] 4,412,431

[45] Nov. 1, 1983

[54] AUTOMOTIVE AIR CONDITIONER EXPANSION TUBE UNIT

[76] Inventor: Henry D. Waldrep, 906 S. Third St., Celina, Tex. 75009

[21] Appl. No.: 306,816

[22] Filed: Sep. 29, 1981

[51] Int. Cl.[3] ..... F25B 41/06

[52] U.S. Cl. ..... 62/511; 138/44

[58] Field of Search ..... 62/511, 527; 138/44, 138/45

[56] References Cited

U.S. PATENT DOCUMENTS

| | | | |
|---|---|---|---|
| 1,957,828 | 5/1934 | Greenwald | 62/511 X |
| 2,781,058 | 2/1957 | Warhus | 62/511 X |
| 3,311,131 | 3/1967 | Zahuranec | 62/511 X |
| 3,642,030 | 2/1972 | Amick | 62/511 X |
| 3,702,144 | 11/1972 | Loveland | 138/44 |
| 3,877,248 | 4/1975 | Honnold, Jr. | 62/511 |
| 3,894,562 | 7/1975 | Moseley, Jr. et al. | 138/44 |
| 4,285,534 | 8/1981 | Katayama et al. | 138/44 X |

FOREIGN PATENT DOCUMENTS

| | | | |
|---|---|---|---|
| 250887 | 5/1963 | Australia | 62/511 |

*Primary Examiner*—Lloyd L. King

*Attorney, Agent, or Firm*—Warren H. Kintzinger

[57] ABSTRACT

Expansion tube fitting unit for automotive air conditioning systems, emphasizing a one-piece reversible tube valve unit, particularly in substitution for existing expansion tube valve units with positive reversal of the new and improved expansion valve unit to prolong use life not only of existing air conditioning systems, such as automotive air conditioning systems, but air conditioning systems in general, as well as for application in initial or new system installations.

3 Claims, 4 Drawing Figures

COMPRESSOR
CONDENSER
ACCUMULATOR
EVAPORATOR COOLING SECTION

AUTOMOTIVE AIR CONDITIONER EXPANSION TUBE UNIT

Heretofore, difficulty has been encountered in the installation, use and maintenance of filter type expansion valve tube units for air conditioning systems, particularly automotive air conditioning systems, in that such systems employ only uni-directionally locatable filter units which are preseated, and, therefore, pre-oriented in the flow path of the overall air conditioning system.

For example, if the filter type expansion tube unit of the prior art, through human error, is inserted backwardly, its use effectiveness in the flow line between the condenser and evaporator is not only eliminated, but flow therethrough is inhibited to such an extent, in operation, that resultant damage to the overall air conditioning system may occur and, in practice, such prior art units have produced at least deleterious effects in the operation of the air conditioning system.

Attempts have, heretofore, been made to correct or, at least, minimize these potential deleterious effects on the overall operation of the air conditioning system, particularly automotive air conditioning systems.

However, such attempts, as far as has been ascertainable, have been unavailing. In any event, the solution to the basic aforementioned unit insertion problem and the attendant secondary problems generated thereby have not been resolved, particularly in the present day manufacture, assembly and use of such automotive air conditioning systems.

These common difficulties and disadvantages of the prior art, among others, are substantially overcome by utilization of the present invention in air conditioning systems, said invention comprising a one-piece preformed, unitary expansion tube unit or device which is easily and rapidly reversible in the fluid flow line to double or prolong the use life of the air conditioning system in which the expansion tube unit of the present invention is employed either as initial equipment or as a substitution for an existing prior art expansion tube unit. Substitution of the expansion tube unit of the present invention for prior art filter units in existing air conditioning systems enhances use life of such units, vis-a-vis, existing equivalent filter units, regardless of the location of the unit in the overall air conditioning system.

Moreover, the expansion tube unit of the present invention is simply removable from a fluid flow line by utilization of a threaded tool efficiently and rapidly, regardless of the end of the unit first inserted in the fluid flow line.

It is, therefore, an object of the present invention to provide new and improved expansion tube units for air conditioning systems, for example, automotive air conditioning systems.

It is another object of the present invention to provide new and improved unitary or one-piece expansion tube units for air conditioning systems.

Still another object of the present invention is to provide such unitary expansion tube units for use in either existing or new air conditioning systems.

A further object of the present invention is to provide such unitary expansion tube units which are reversibly insertable in a fluid flow line of an air conditioning system.

A still further object of the present invention is to provide a one-piece expansion tube removably insertable in an air conditioning fluid flow line which is characterized by structure permitting easy and rapid removal of the expansion tube unit from the fluid flow line and regardless of the end of the unit first inserted in the fluid flow line.

Still another object of the present invention is to provide a unitary expansion tube unit for insertion in fluid flow lines of air conditioning systems provided with internal structure which permits easy and rapid removal of the expansion tube unit from the fluid flow line by employment of a simply constructed tool.

A further object of the present invention is to provide a one-piece reversibly insertable expansion tube for location in fluid flow lines of air conditioning systems which is provided with internal axial threads for easy and rapid removal of the expansion tube unit from the fluid flow line by a complementarily threaded tool.

A still further object of the present invention is to provide a one-piece expansion tube unit having an axial bore therethrough with an internally threaded open female end section at opposite ends of the unit, said threaded sections being adapted to receive a threaded tool to easily and rapidly remove the expansion tube unit from the fluid flow line.

A further object of the present invention is to provide an expansion tube unit for automotive air conditioners which does not include a separate mesh type filter and which includes a reduced diameter axial bore therethrough to prevent large size foreign particles from passing into the evaporator cooling section while permitting passage through the bore of relatively harmless foreign solid particles.

These and other objects, features and advantages of the present invention will become readily apparent from a careful consideration of the following detailed description, when considered in conjunction with the accompanying drawings wherein like reference numerals and characters refer to like and corresponding parts throughout the several views, and wherein.

Figures 1, 2, 3, 4:
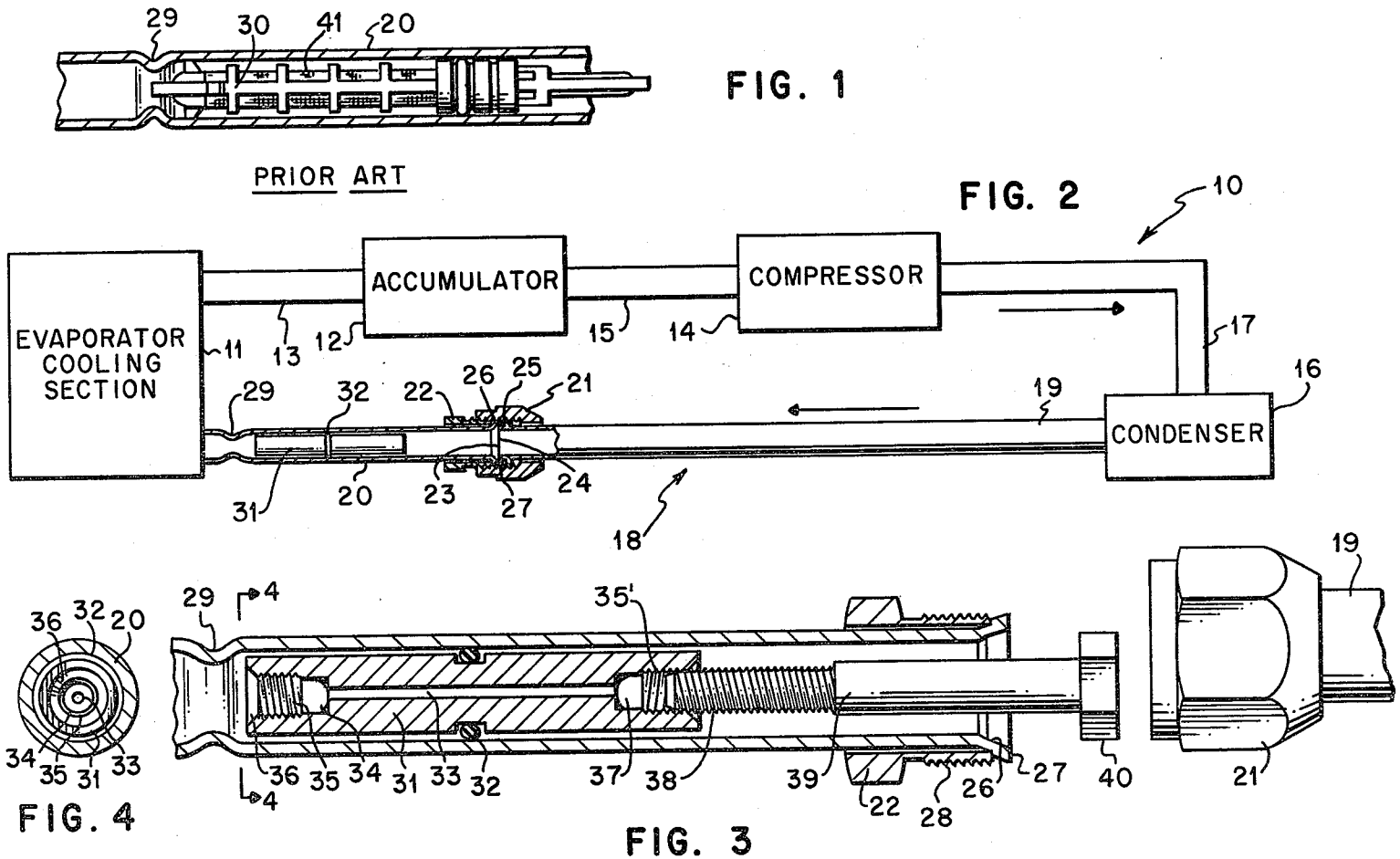
PRIOR ART FIG. 1
FIG. 1 is a partial fragmentary view in cross section of a prior art expansion tube filter unit used in automotive air conditioning systems.
FIG. 2 is a block diagram of a typical air conditioning system partially broken away to illustrate the expansion tube unit of the present invention located in the air conditioning system as a substitute for the prior art unit of FIG. 1.
FIG. 3 is an enlarged view in cross section of the expansion tube unit of the present invention in situ in the fluid flow line as illustrated in FIG. 2.
FIG. 4. is a view taken along line 4-4 of FIG. 3.

Referring now to the drawing and particularly to FIGS. 1 and 2, there is disclosed a conventional automotive air conditioning system, generally indicated by the numeral 10, including an evaporator cooling section 11 in fluid communications with an accumulator 12 through fluid flow line 13. Accumulator 12 is in fluid flow communication with a compressor 14 through line 15 and compressor 14 likewise is in fluid communication with a condensor 16 through line 17. To complete fluid flow, in the directions indicated by arrows, through the system 10, the condensor 16 is in fluid flow communication with the evaporator cooling section 11 through a fluid flow line, generally indicated by the numeral 18, consisting of two sections 19 and 20, respectively (FIG. 2).

These two sections 19 and 20 are releasably coupled by fitting members 21 and 22. The fitting 21 is carried for rotation by the section 19, is also axially movable within prescribed limits thereon and is provided with an internal threaded portion 23 for engagement with a corresponding externally threaded portion 28 on the fitting 22, as best seen in FIG. 3.

The coupler fitting 22 is rotatably carried by the section 20 for limited axial movement to permit threading of the two coupler fittings 21 and 22.

An annular seal 25 seats against a recess 26 defined by a flared end section 27 (FIG. 3) of the section 20 which receives the end of the section 19, whereby engagement of the threaded fittings 21 and 22 compresses the seal 25 to assure a leak proof internal flow path between the sections 19 and 20. Note that the flared end section 27 of the section 20 acts as a stop limit for axial movement of the fitting 22. The end surface 24 of the flared end 27 engages the annular internally positioned rim 23 which positively seats the seal 25 against the recess 26 of the fitting fluid flow line section 20. The coupling fittings 21 and 22 are conventional coupling fittings and form no part of the present invention.

Referring now to FIG. 1, there is shown a conventional expansion tube unit 30 constructed of plastic and having a cylindrical elongated mesh filter 41. A seat 29 formed as by crimping in the line 20 limits movement of the filter type expansion unit of FIG. 1 which is introduced into the line 20 at the coupling defined by fittings 21 and 22. The conventional filter type expansion unit 30 is inserted into the line 20 and is usually seated on the crimp seat 29 closely adjacent the coupler fittings to facilitate insertion and removal of the unit 30 in the line 20. Because of its fragile construction, usually of plastic, effective utilization of the prior art unit 30 requires its careful insertion into and removal from the line 20. If inadvertently inserted backwardly, the efficiency of the filter unit 30 is substantially reduced and the possibility of damage thereto enhanced. It has also been found that incorrect insertion of the filter unit 30 can also cause damage to the evaporator cooling section 11. Moreover, insertion and removal of the unit 30, even if inserted in the line 20 correctly, is a time consuming process, because of the delicate construction of the unit 30, as well as because of the buildup of sediment on the mesh screen filter 41.

A rugged, unitary, one-piece reversibly insertable and removable expansion tube unit of the present invention is illustrated in FIGS. 3 and 4. The expansion tube unit of the present invention includes a cylindrical body 31 carrying an external annular seal 32 compressable between the tube section 20 and the cylindrical body 31 to prevent fluid flow between the tube 20 and the expansion tube unit body 31 of the present invention.

The unit body 31 is provided with an axial reduced diameter elongated bore 33 communicating with substantially identical enlarged diameter bores 34 and 37 at the respective opposite ends of the bore 33. The bores 34 and 37 are preferably of the same diameter and are provided with outwardly facing oppositely threaded bore sections 35 and 35'. The bore sections 35 and 35' each terminate outwardly in a flared section 36. It is noted that to provide a streamlined flow path into and from the reduced diameter bore 33, the communicating bore sections 34 and 37 are each provided with a semispherical surface adjacent the bore 33.

As shown in FIG. 3, the expansion tube unit 31 is seatable on an existing crimp seat 29, when the expansion tube unit 31 is substituted in existing air conditioner system installations for the conventional filter type expansion tube units 30, such as shown in FIG. 1. Advantageously, the expansion tube unit of the present invention permits the crimp seat 29 to be located adjacent or contiguous to the evaporator cooling section 11, as shown in FIG. 2.

An expansion tube unit constructed in accordance with the present invention may be easily, readily and positively seated in the flow line 20 of the air conditioning system by employment of a tool having a threaded end 38 joined to a shank 39 carrying a terminal end 40. The tool is threadable in either of the threaded ends 35 or 35' of the expansion tube unit 31 and, when so threaded, the tool may be used to insert into or remove the expansion tube unit from the line 20, regardless of which end of the expansion tube unit happens to be inserted first in the tube 20. Thus, a simple, one piece tool may be employed to insert or remove the expansion tube unit of the present invention in the fluid flow line, regardless of which end of the unit 31 is first inserted in the tube 20. Once the unit 31 has been seated on the crimp 29, the tool is unthreaded and removed from the tube 20. The fittings 19 and 20 are then coupled to close the fluid flow line sections 19 and 20. Similarly, to remove the unit 31 from the tube 20, the fittings 21 and 22 are uncoupled, the tool threaded into the threaded section 35 or 35' adjacent the fitting 22, and the connected tool and unit 31 removed from the line section 20. The tool is then unthreaded from the unit 31. If the unit 31 is to be reused in the line 20, the unit 31 is reversed, the tool threaded in the other section of the unit 31 and employed to seat the unit 31 against the crimp 29. The tool is then unthreaded once the unit 31 is seated, removed from the tube section 20 and the fittings 21 and 22 again coupled to close the line sections 19 and 20.

It will be appreciated that mesh filters need not be employed in the expansion unit of the present invention and that the reduced elongated bore 33 will effectively prevent large size undesirable particles from entering the evaporator cooling section while permitting smaller sized undesirable foreign particles to pass through the unit 31 into the evaporator cooling section 11, with such smaller size particles generally not affecting or damaging the evaporator cooling section 11.

Thus, the present invention provides a rugged, one piece, unitary expansion tube unit which is reversibly insertable into and removable from an air conditioning system fluid flow line by employment of a simply constructed one piece insertion and removal tool.

While there has been disclosed in the foregoing specification and drawing a preferred embodiment of the present invention and the best mode presently known for making the same, it will be apparent to those skilled in the art that other modifications and equivalents thereof exist and it is to be understood that the present invention is to be limited only by the scope of the accompanying claims.

I claim:

1. An end to end reversible expansion tube unit used in air conditioning systems comprising: a body having an axially extended circular bore therethrough communicating at each end with an enlarged diameter internally threaded bore chamber; and a tool for insertion and removal of said expansion tube unit including: a bolt unit having a shank with a threaded section threadable into corresponding threads of the enlarged diameter internally threaded bores, said shank extended to turning means thereof for manually thread turn engaging and unthread turn disenengaging said tool from said threaded bores.

2. The unit of claim 1, wherein the enlarged bores are provided with oppositely tapped identical threads.

3. The unit of claim 1, wherein the body is cylindrical and carries a peripheral "O" ring seal in an annular groove located at the longitudinal center of said expansion tube unit.

* * * * *